United States Patent [19]

Silver

[11] Patent Number: 4,737,895

[45] Date of Patent: Apr. 12, 1988

[54] LOW TEMPERATURE STARTING FLUORESCENT FIXTURE

[76] Inventor: Harry Silver, 1844 Meadowbrook Rd., Abington, Pa. 19001

[21] Appl. No.: 70,305

[22] Filed: Jul. 6, 1987

[51] Int. Cl.[4] ..... F21S 3/14

[52] U.S. Cl. ..... 362/225; 315/115; 362/260

[58] Field of Search ..... 315/113, 114, 115; 362/225, 216, 260

[56] References Cited

U.S. PATENT DOCUMENTS 1,643,146 9/1927 Alexander ..... 315/113
3,093,321 6/1963 Christy ..... 362/225 X
3,996,493 12/1976 Davenport et al. ..... 362/221 X
4,645,974 2/1987 Asai ..... 315/115 X

FOREIGN PATENT DOCUMENTS 2146755 4/1985 United Kingdom ..... 362/225

*Primary Examiner*—Tony M. Argenbright
*Assistant Examiner*—Eric R. Carlberg
*Attorney, Agent, or Firm*—Paul Lipsitz

[57] ABSTRACT

A fluorescent lighting fixture adapted for low temperature conditions which is fitted with a relatively high wattage fluorescent lamp and a lower wattage fluorescent lamp whereby said lower wattage lamp is lighted at lower temperature and provides heat to raise the temperature of the higher wattage lamp to a lighting condition.

8 Claims, 2 Drawing Sheets

LOW TEMPERATURE STARTING FLUORESCENT FIXTURE

This invention relates to an improved fluorescent lighting fixture and, in particular, is directed to such a fixture which is operable at low temperatures.

BACKGROUND OF THE INVENTION

Low wattage, compact, single-ended, fluorescent lamps of H-shaped tubular design are known and have been used in lighting fixtures. These lamps are also known as "twin tubes" and are available commercially from North American Phillips Lighting Company, Hightown, N.J., Osram of Newburgh, N.Y. and other vendors and are disclosed in detail in the various manufacturer's specification sheets.

These compact, energy saving, fluorescent lamps function in a manner similar to the larger tubular fluorescent lamps which are coated on the inside with a phosphor and are filled with mercury vapor and with a small amount of argon to facilitate starting. They also employ a preheat type of starter switch built into the lamp base, and have an external choke (ballast) in series with one side of the line voltage to limit the current flow when the lamp is operating. The recently available H-shaped, low wattage fluorescent lamps are available in 5, 7, 9 and 13 watts and like the larger, older type, linear lamps, they are temperature sensitive. The 5 and 7 watt H-shaped lamp is able to start at an environmental temperature down to about 0° F. and the 9 watt lamp functions at a temperature down to about 25° F., but these lamps have limited lumen output. The higher lumen output 13 watt H-shaped lamp, however, which has become available recently, either does not start at temperatures below about 32° F. or requires a relatively long time to light fully and its long starting time causes a reduced lamp life and thus these lamps cannot be used in lighting fixtures exposed to such low temperatures. Similarly, a most recent type of fluorescent lamp in wattages of 10, 13, 14, 18, 20, and 26 watts available from North American Phillips is known as "quads" and are clusters of two compact H-shaped lamps in a single base. These lamps are subject to lighting problems below about 32° F. and like any of these compact lamps, such lamps above 7 watts are excluded from use in outdoor lighting fixtures in cold weather climates, in refrigerated rooms and the like. The present invention provides a means to overcome this deficiency.

BRIEF STATEMENT OF THE INVENTION

In accord with this invention, a lighting fixture is provided which is fitted with one or more of a first, low temperature sensitive, H-shaped fluorescent lamp and also is fitted with one or more of a second H-shaped fluorescent lamp of lower wattage than said first lamp whereby the heat generated by the lighted lower wattage lamp raises the temperature within the lighting fixture to a temperature sufficient to initiate lighting of the first temperature sensitive lamp. In a further embodiment, a heat conveyor is fitted from the base of the lower wattage lamp to the base of the first temperature sensitive lamp to expedite heat transfer.

DETAILED DESCRIPTION OF THE INVENTION

Figure 1:
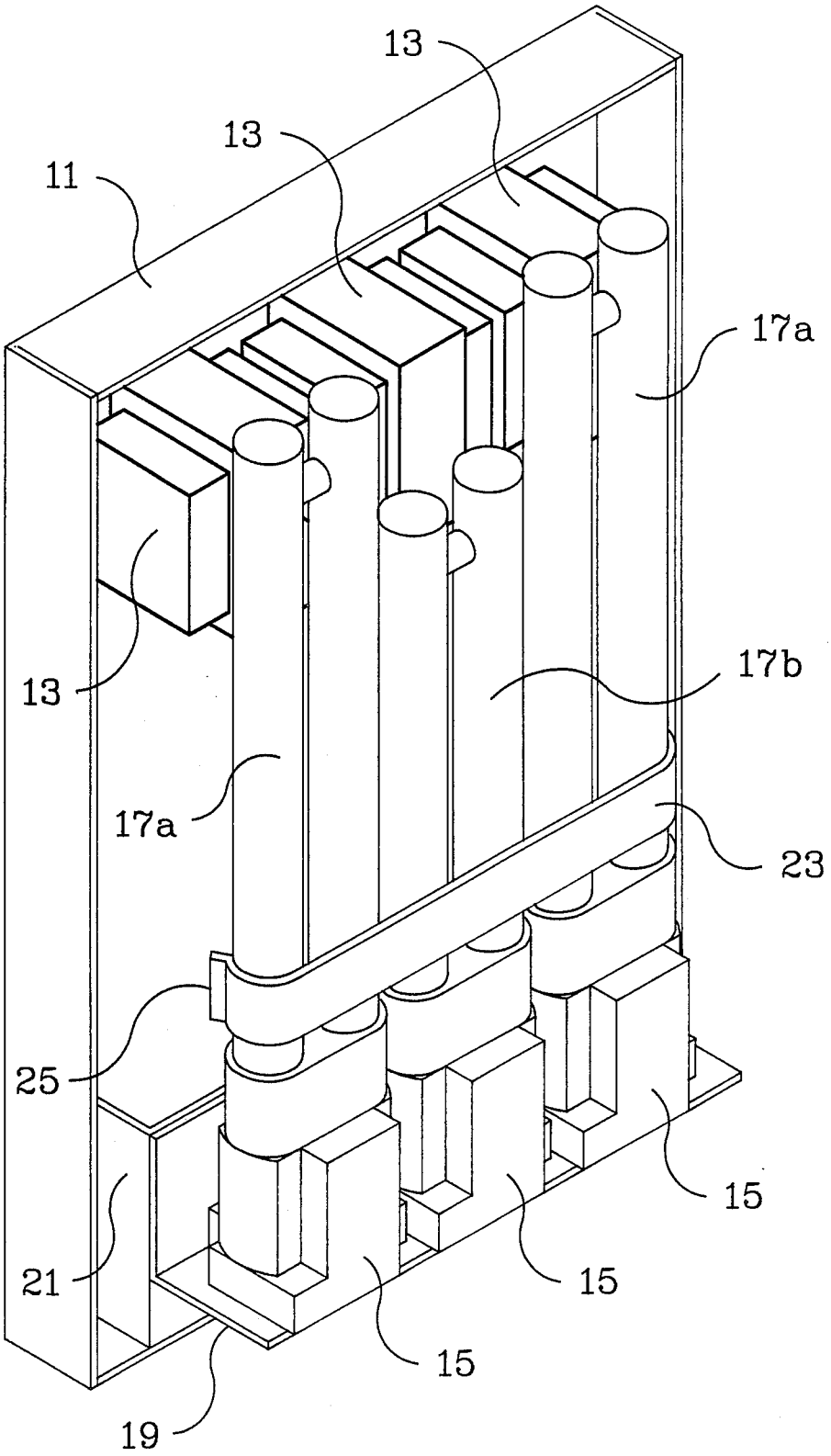
FIG. 1 is a perspective view of a typical fixture without a cover showing the placement of several H-shaped lamps within a fixture casing.

Referring now to FIG. 1, a perspective view is shown of a fixture containing two higher wattage (13 W) temperature sensitive lamps and one lower wattage (7 W) lamp. A case (11) provides means for mounting the internal parts of the fixture and a cover (not shown), which is preferably of glass or translucent plastic, fits around the perimeter of the case. Mounted within the case (11) are three chokes (13), each one being wired between one side of the line voltage and one side of a socket (15) for an H-shaped fluorescent lamp. The lamp sockets shown (15) are bi-pin base type sockets mounted on a bracket (19) fastened to a mounting board (21) which is affixed to the case (11). Other obvious mounting means may, of course, be used. The other electrical side of each of the lamp sockets (15) is wired directly to the other side of the line voltage input. Lamps 17*a* are the higher 13 watt lamps and the smaller lamp 17*b* is a lower wattage 5 or 7 watt lamp.

In operation, when the covered lamp fixture is turned on, lower wattage lamp 17*a* lights immediately if the temperature is no less than about 0° F. and lamp 17*b* will also light immediately as long as the temperature is no less than about 32° F. However, if the temperature is below about 32° F., lamp 17*b* will light in a few moments (usually less than about 20 seconds) as the heat from lamp 17*a* and its socket raises the temperature within the fixture to a temperature sufficient to light the lamp quickly (about 32° F.). In this way, the full potential of a higher wattage fluorescent fixture is achieved and the life of the lamp is not adversely affected.

In a further embodiment of the invention a heat transfer device may be employed to convey heat from the lighted lower wattage fluorescent lamps to the unlit lamp and such device is shown in place in FIG. 1. As shown in FIG. 1, this device is a thin heat conducting strip (23), preferably of brass or aluminum, which snaps in place onto the fluorescent lamps by means of flexible clips (25) to which the strip is attached. The strip may be placed across the bottom portion of the tubular lamps as shown or, preferably, across the lamp bases just above the sockets (15) into which the lamps are positioned. The use of this heat conductor enables the higher wattage lamp to be heated more quickly and thus reduces the time required for such lamp to light under low temperature conditions.

It will be understood that various combination of higher and lower wattage lamps may be used in carrying out the invention. For example, instead of two 13 watt lamps and one lower wattage lamp, one each of the higher and lower wattage lamp may be used. Alternatively, the higher wattage lamp may be a 9 watt lamp (which will not light below about 25° F.) and the lower wattage lamp a 5 or 7 watt lamp. Also, more than a total of three lamps may be used as required by the design of the lighting fixture.

Figure 2:
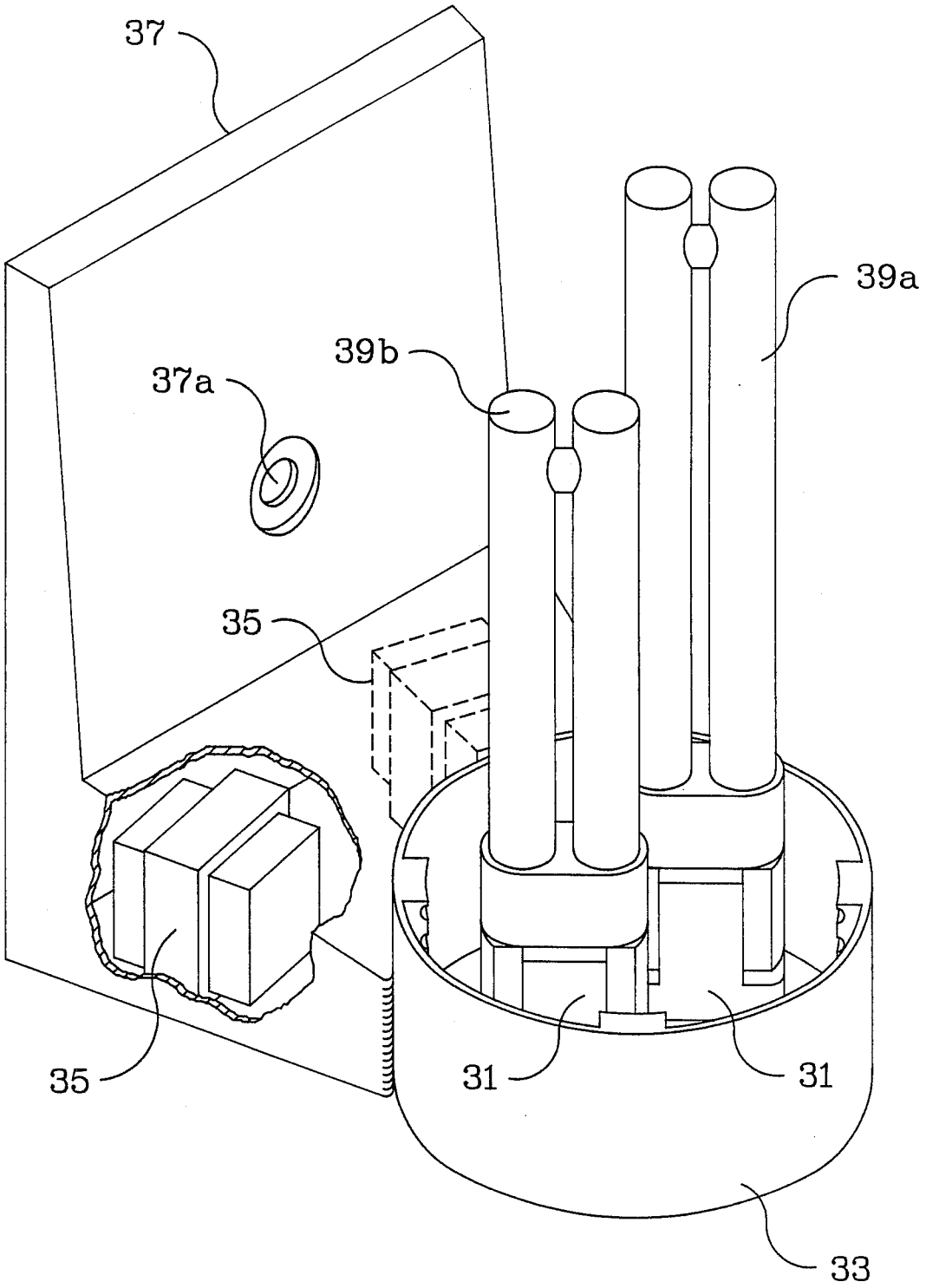
FIG. 2 shows a perspective view of a low wattage lamp and a higher wattage lamp of the invention in an alternative fixture design.

It will also be understood, of course, that the configuration of the fixture shown in FIG. 1 may be varied without departing from the spirit and scope of the invention. For example, as shown in FIG. 2, the lamp sockets (31) may be mounted at the bottom of a cylindrical supporting base (33) with the chokes (35) mounted behind the base support (33). As shown in FIG. 2 by the cut-away section and the dashed lines, the chokes (35) are mounted on a bracket (37) to which the cylindrical base is attached. A mounting hole (37*a*) is shown on the bracket (37). Preferably the chokes are held in place by a potting resin, but other supporting means may, of course, be used. Lamp 39*a* is a 13 watt compact lamp and lamp 39*b* is a 7 watt lamp, both mounted in sockets 31. The cylindrical base is fitted with a translucent glass or plastic cover (not shown). Other configurations of the fixture will be obvious to the skilled art worker.

I claim:

1. In an enclosed fluorescent lighting fixture fitted with a first relatively high wattage fluorescent lamp which is unable to light at low temperatures, the improvement which comprises employing in the electrical circuitry of said fixture at least one second lower wattage fluorescent lamp capable of lighting at a temperature lower than said first lamp, whereby when said fixture is activated and said second lamp lights, heat supplied by said second lighted lamp raises the temperature within said fixture to a temperature sufficient to light said first lamp.

2. The lighting fixture of claim 1 wherein the first high wattage lamp is a 13 watt lamp and the second lower wattage lamp is a 5 or 7 watt lamp.

3. The lighting fixture of claim 1 wherein the first high wattage lamp is a cluster compact lamp and the second lower wattage lamp is a 5 or 7 watt lamp.

4. In an enclosed fluorescent lighting fixture fitted with a 13 watt or higher wattage fluorescent lamp which is unable to light due to an environmental temperature below about 32° F., the improvement which comprises, including in the electrical circuitry of said fixture, at least one lower wattage fluorescent lamp, whereby when said fixture is activated and said lower wattage lamp lights, heat from said lighted lower wattage lamp raises the temperature within said fixture to above about 32° F. thereby allowing said 13 watt or higher wattage lamp to light.

5. The fixture of claim 4 wherein the 13 watt or higher wattage lamp is a cluster compact lamp.

6. The fixture of claim 4 wherein a heat conductor is positioned adjacent the fluorescent lamps to conduct heat from said lighted lower wattage lamp to said 13 watt or higher wattage lamp.

7. The fixture of claim 6 wherein the heat conductor is made of brass or aluminum.

8. The fixture of claim 6 wherein the heat conductor is placed across the bases of said lamps.

* * * * *